US005718016A

United States Patent [19]

Sung

[11] Patent Number: 5,718,016

[45] Date of Patent: Feb. 17, 1998

[54] NOZZLE ASSEMBLY FOR VACUUM CLEANERS

[76] Inventor: Jennifer Sung, 11 F, No. 56, Mai Gin Rd., Keelung, Taiwan

[21] Appl. No.: 552,723

[22] Filed: Nov. 2, 1995

[51] Int. Cl.[6] ..... H47L 9/06

[52] U.S. Cl. ..... 15/339; 15/396; 15/398; 15/227; 15/415.1

[58] Field of Search ..... 15/227, 415.1, 15/398, 402, 399, 400, 339, 396

[56] References Cited

U.S. PATENT DOCUMENTS

| | | | |
|---|---|---|---|
| 1,012,634 | 12/1911 | Guild | 15/398 |
| 1,431,943 | 10/1922 | Gee | 15/397 |
| 3,082,466 | 3/1963 | Tucker et al. | 15/397 X |

FOREIGN PATENT DOCUMENTS

| | | | |
|---|---|---|---|
| 42 05 693 | 8/1996 | Germany . | |
| 734360 | 7/1953 | United Kingdom | 15/402 |
| 95/14420 | 6/1995 | WIPO . | |

*Primary Examiner*—Chris K. Moore

*Attorney, Agent, or Firm*—Jeffer, Mangels, Butler & Marmaro LLP

[57] ABSTRACT

A nozzle assembly includes: a glove having a plurality of separate flexible sheaths for putting on a user's hand, the glove being deformable with the movement of the fingers of the user; and a hose having a first end adapted for coupling to the input port of a vacuum cleaner, and a second end terminating in a plurality of flexible nozzle tubes respectively fastened to the sheaths of the glove, each tube having defined therein a longitudinal series of holes through which air is drawn into the vacuum cleaner through the hose when the vacuum cleaner is operated.

4 Claims, 4 Drawing Sheets

NOZZLE ASSEMBLY FOR VACUUM CLEANERS

FIELD OF THE INVENTION

The present invention relates to a nozzle assembly for vacuum cleaners, which is designed to be put on the hand and connected to a vacuum cleaner for cleaning furniture, etc.

BACKGROUND OF THE INVENTION

Various vacuum cleaners have been developed for cleaning floors, etc. by drawing in air and dust together. These vacuum cleaners are generally comprised of a motor housing assembly, and a hose having one end connected to the input port of the motor housing assembly and an opposite end attached with a multipurpose brush, dusting brush, or furniture nozzle through a converter. Conventional vacuum cleaners are functional for cleaning floors, however they are not convenient for cleaning slotted, recessed, invisible areas or dead corners in furniture, automobile accessories, etc. Besides, when conventional vacuum cleaners are coupled with a furniture nozzle and used to clean flexible and light materials such as clothes, curtains, cloth coverings, foot pads, etc., the object tends to be stuck in the furniture nozzle, causing the operation interrupted. Furthermore, because the furniture nozzle, dusting brush, etc. is not flexible, it cannot be deformed to fit the curvature of a curved object. Therefore, must time will be wasted when cleaning an uneven floor or any object which has a curved surface.

SUMMARY OF THE PREFERRED EMBODIMENTS

The present invention has been accomplished to provide a nozzle assembly for vacuum cleaners which eliminates the aforesaid drawbacks.

According to a preferred embodiment of the present invention, the nozzle assembly comprises a glove and a hose for coupling the glove to a vacuum cleaner. The glove is flexible and can be deformed with the movement of the fingers. The hose has one end terminating in a plurality of flexible nozzle tubes, which are respectively fastened to the separate sheathes of the glove and have defined therein a respective longitudinal series of holes for drawing in air together with dust upon the operation of the vacuum cleaner.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

DETAILED DESCRIPTION OF THE PREFERRED EMBODIMENTS

Figure 1:
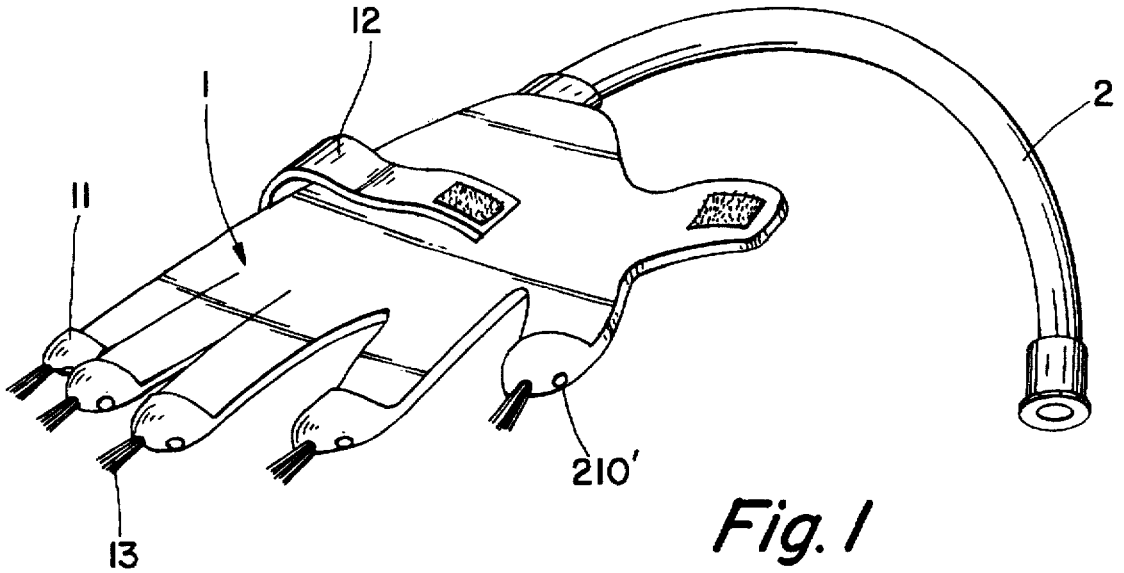
FIG. 1 is an elevational view of a nozzle assembly according to the present invention.
Figure 2:
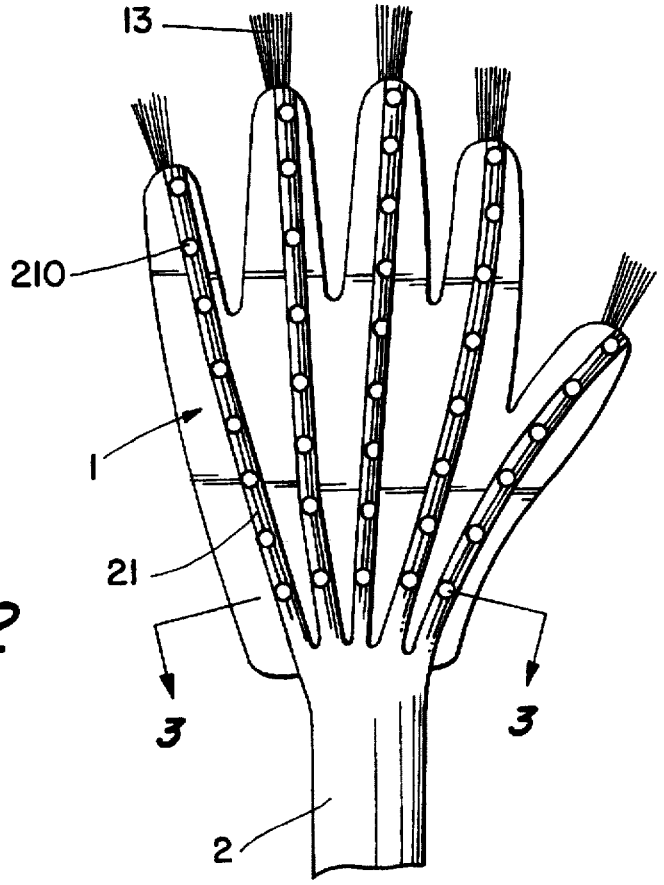
FIG. 2 is a bottom plain view of the nozzle assembly shown in FIG. 1.

Referring to FIGS. 1 and 2, a preferred embodiment of the nozzle assembly for vacuum cleaners in accordance with the present invention is generally comprised of a glove 1, and a hose 2 connected to the glove 1. The glove 1 is made from cloths or flexible plastics that moves with the fingers, having separate sheaths 11 for each finger, and a glove strap 12 for securing the glove 1 to the wrest. Each sheath 11 of the glove 1 preferably is mounted with a brush 13 at the end for cleaning and scrubbing. The hose 2 terminates in a plurality of flexible nozzle tubes 21 respectively fastened to the sheaths 11, each nozzle tube 21 having defined therein a longitudinal series of holes 210. Each nozzle tube 21 further has a hole 210' disposed at the end of the respective sheath 11.

Figure 3:
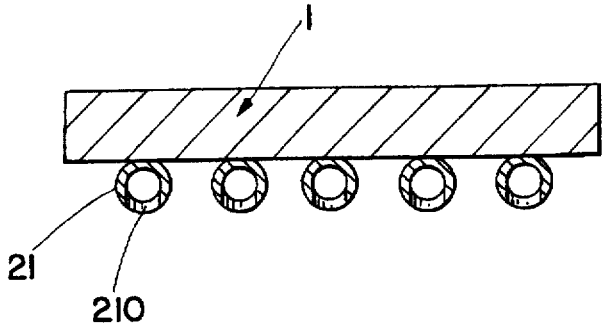
FIG. 3 is a sectional view taken along line 3—3 of FIG. 2.
Figure 4:
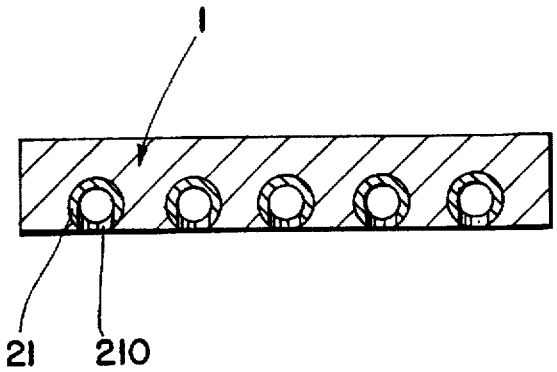
FIG. 4 is similar to FIG. 3 but showing an alternate arrangement of the nozzle tubes according to the present invention.

Referring to FIGS. 3 and 4, the nozzle tubes 21 of the hose 2 may be mounted outside the sheaths 11 of the glove 1 (as shown in FIG. 3), or inside the sheaths 11 of the glove 1 (as shown in FIG. 4). When the vacuum cleaner is turned on, currents of air are drawn through the holes 210 and 210', of the nozzle tubes 21 into the hose 2.

Figure 5:
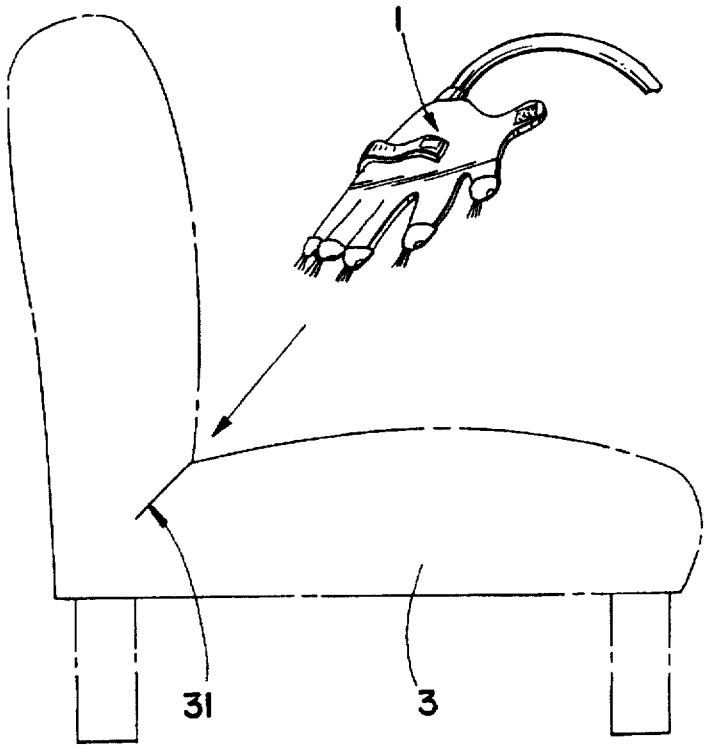
FIG. 5 shows an application example of the present invention.
Figure 7:
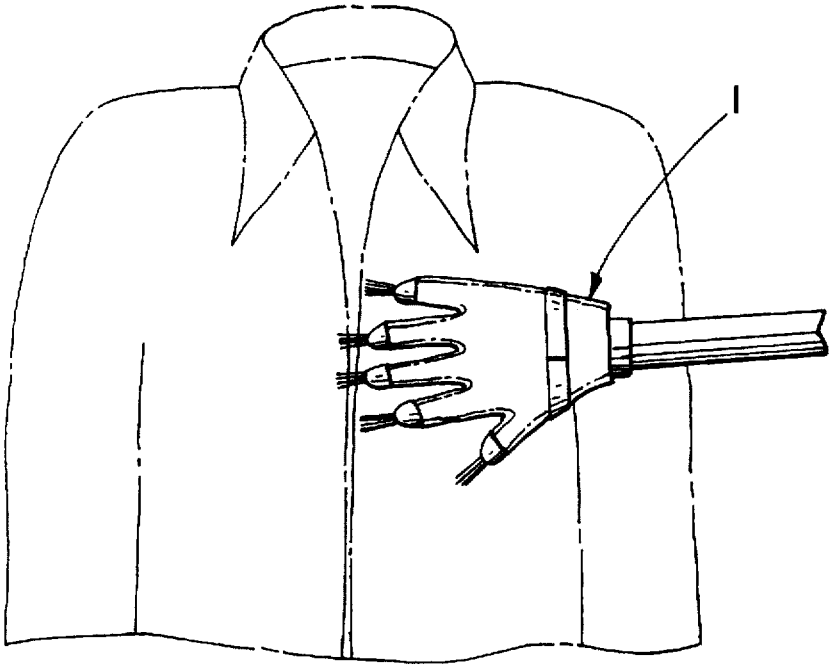
FIG. 7 shows still another application example of the present invention.
Figure 6:
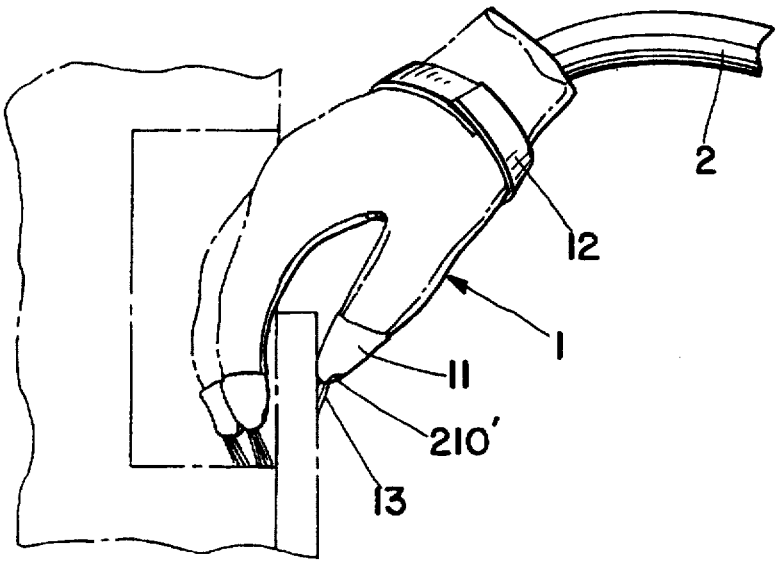
FIG. 6 shows another application example of the present invention.
Figure 8:
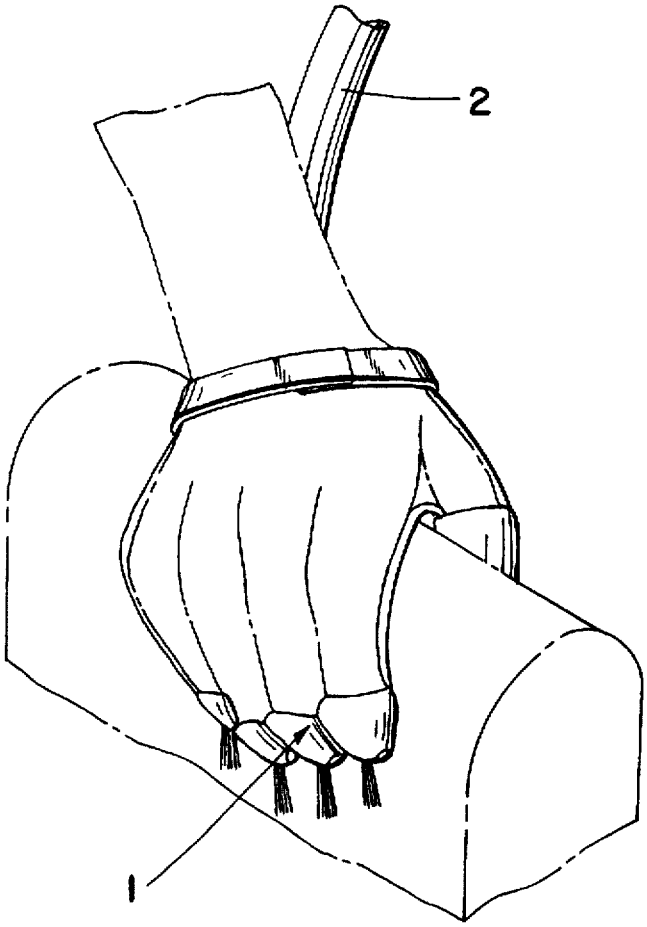
FIG. 8 shows still another application example of the present invention.

Figures from 5 to 8 show various application examples of the present invention. As illustrated in FIG. 5, the sheaths 11 of the glove 1 can be inserted into the gap between the upholstered seat and upholstered back of a chair to remove dust from it. As shown in FIG. 6, the sheaths 11 of the glove 1 can also be inserted into a recessed area in a furniture to clean the dean corner. By tenderly scrubbing the clothes with the glove 1 as shown in FIG. 7, dust is removed from the clothes. Because the glove 1 is made from flexible materials, it can be conveniently deformed by the fingers to fit the curvature of the object to be cleaned, as shown in FIG. 8.

What is claimed is:

1. A nozzle assembly comprising:

a glove having a plurality of separate flexible sheaths for putting on a user's hand, said glove being deformable with the movement of the fingers of said user; and a hose having a first end adapted for coupling to the input port of a vacuum cleaner, and a second end terminating in a plurality of flexible nozzle tubes each respectively fastened to a corresponding one of said sheaths of said glove, each said tube having defined therein a longitudinal series of holes for direct application to a work surface through which air and dust are drawn into said vacuum cleaner through said hose and tubes when said vacuum cleaner is operated.

2. The nozzle assembly of claim 1 wherein at least one said sheath of said glove has a front end mounted with a brush.

3. The nozzle assembly of claim 1 wherein said plurality of flexible nozzle tubes are mounted outside said glove.

4. The nozzle assembly of claim 1 wherein said plurality of flexible nozzle tubes are mounted inside said glove and said glove has defined therein a plurality of holes aligned with said plurality of holes in said plurality of flexible nozzle tubes.

* * * * *